US006179233B1

(12) United States Patent
Cordonnier et al.

(10) Patent No.: US 6,179,233 B1
(45) Date of Patent: Jan. 30, 2001

(54) WET CRUSHING PROCESS AND CRUSHER FOR IMPLEMENTING SUCH PROCESS

(75) Inventors: Alain Cordonnier, Lille; Bernard Gaucherand, Varces, both of (FR)

(73) Assignee: FCB Societe Anonyme, Montreuil (FR)

( * ) Notice: Under 35 U.S.C. 154(b), the term of this patent shall be extended for 0 days.

(21) Appl. No.: 09/171,355

(22) PCT Filed: Apr. 15, 1997

(86) PCT No.: PCT/FR97/00681

§ 371 Date: Dec. 15, 1998

§ 102(e) Date: Dec. 15, 1998

(87) PCT Pub. No.: WO97/39829

PCT Pub. Date: Oct. 30, 1997

(30) Foreign Application Priority Data

Apr. 23, 1996 (FR) ..... 96 05074

(51) Int. Cl.[7] ..... B02C 15/16
(52) U.S. Cl. ..... 241/61; 241/228
(58) Field of Search ..... 241/117–121, 228, 241/79.3, 60, 61, 79.2

(56) References Cited

U.S. PATENT DOCUMENTS 1,577,376 * 3/1926 Silva .
1,603,639 * 10/1926 Reed .

FOREIGN PATENT DOCUMENTS

0486371 * 5/1992 (EP) .
1444397 * 5/1966 (FR) .
2524819 * 10/1983 (FR) .
2021439 * 12/1979 (GB) .
3-213156 * 9/1991 (JP) .

* cited by examiner

*Primary Examiner*—Mark Rosenbaum
(74) *Attorney, Agent, or Firm*—Harrison & Egbert

(57) ABSTRACT

A grinder for use in wet grinding having a roller or wheel rolling on a circular track and elastically pressed thereon. The materials to be ground are subjected to several layer on bed grinding operations to enable the rational utilization of this type of grinder. During the time between two successive grinding operations in the grinder, water or another liquid is introduced by nozzles to the materials. The materials are drained and/or dried by a screen so as to reduce water content to below 20% in volume.

18 Claims, 4 Drawing Sheets

WET CRUSHING PROCESS AND CRUSHER FOR IMPLEMENTING SUCH PROCESS

TECHNICAL FIELD

The present invention relates to wet crushing and to crushers comprising at least one roller travelling over a circular track and elastically pressed against the latter.

BACKGROUND ART

Known crushers of the type defined above, a vertical crusher or ring crusher, in which a multi-granular layer of materials for crushing is compressed between the roller and the track with sufficient pressure to crush the grains and cause their fragmentation to smaller grains, are not suited to wet crushing as an excessive water content in the materials for crushing reduces their efficiency. In wet crushing, the materials for crushing generally have a water content of 10% to 60% by weight, with an average of 30%, which is incompatible with good crushing efficiency.

The object of the present invention is to permit the rational use of crushers of this type for wet crushing.

SUMMARY OF THE INVENTION

The process according to the present invention includes in subjecting the materials for crushing to several crushing operations by crushing in a layer or bed of materials and, during their dwell time in the crushing apparatus, and between two successive crushing operations, in adding water or another liquid to the materials to re-expand the layer of materials and to enable the progress of the materials through the crushing apparatus to be controlled and, possibly, to enable their grain size grading to be ensured, and then in draining the materials and/or removing moisture therefrom so as to reduce their water content to less than 20% by volume. The draining and moisture removal operations are carried out inside the crushing apparatus, which is arranged for this purpose, which makes it possible to achieve a considerable reduction in the cost of the plant by avoiding the use of auxiliary apparatus and means of transport between the different apparatus.

For the purpose of implementing the invention, use will be made of a crusher comprising a circular track, fictitiously divided into several track elements, or circular tracks, spaced apart from one another, where the successive crushing operations will be carried out, means for transferring the materials from one track or track element to the next, means for projecting water or another liquid onto the materials during their transfer from one track or track element to the next, and means suitable for ensuring the draining of the materials and/or removal of moisture therefrom prior to their next passage beneath the roller. In a ring crusher having a horizontal axis, the tracks will be disposed side by side.

The addition of water or of another liquid to the materials after each crushing operation makes it possible, on one hand, to improve the flow of the materials and their distribution in a layer of uniform thickness over the track, and, on the other hand, to remove the fine particles immediately after their production, which makes the subsequent crushing operations more efficient.

The water or any other liquid can be projected onto the materials when they are still on the track, for example by means of nozzles supplied under pressure which then constitute one of the means for transferring the materials from one track or track element to the next. In particular, when the crusher is of the rotary ring type and is driven in rotation at a speed greater than the critical speed so that the centrifugal force is sufficient to maintain a layer of materials over the entire periphery of the track provided on the ring, use can be made of nozzles placed inside the ring, in its upper portion and on the rising side, and the jets of which will be directed towards the track to detach the materials; the action of the jets can be supplemented by that of a scraper. Moisture removal can be effected through the action of the centrifugal force in the portion of the track located upstream of the crushing roller. A pre-compression roller can be provided on the track, immediately ahead of the crushing roller, to ensure complementary moisture removal by pressure.

According to a preferred form of embodiment of the invention, the crusher is of the rotary ring type and the material feed device comprises one or more baffle or deflecting plates arranged so as to intercept the materials detached from the track provided inside the ring and orientated so as to deflect them in a direction having a component parallel to the axis of the ring; additional water spraying means can be provided above the deflecting plate or plates to facilitate the flow of the materials. Alternatively, the deflecting plate or plates can be porous, and water or another liquid can be injected through the plate(s) to create a liquid film facilitating the flow of the materials. The deflecting plate or plates can comprise an upper screening surface and means for collecting and discharging the water and the fine crushed products that pass through this surface; they then constitute a means for draining the coarse materials. They can be flat or curved, and each plate will be orientatable about a horizontal axis, and possibly inclinable about a vertical axis, so as to be able to adjust the feeding speed of the materials for crushing and choose the point at which the materials deflected by the plate(s) fall back onto the track. The removal of moisture from the materials is carried out, through the action of the centrifugal force, in the area of the track located between the point at which the materials deflected by the deflecting plate or plates fall back onto the track and the roller. Preferably, this area will have an angular extent of at least 30°.

In the event of the track being formed inside a drum with a horizontal axis and of supply and discharge areas being arranged on either side of the track, drainage means can be provided in these areas to facilitate discharge of the water. For the same purpose, when the track is constituted by protection plates resting on the shell of the drum, which is generally the case, drainage means can be provided under the plates, in the crushing area. A grooved roller can also be used. At its ends, the drum will be provided with annular barrier-forming rims the inside diameter of which will be chosen to retain the material within the supply and discharge areas, respectively, while, at the same time, possibly enabling the water to be discharged by overflowing. These rims can be designed in such a way that is possible to change their inside diameter in order to adjust their height (radial dimension). The materials retained by these rims form, at least at the crushing area, a bank that prevents the materials compressed between the roller and the track from being expelled laterally by the pressure while, at the same time, enabling the water to be discharged partially through the said bank, if the supply area, or discharge area, respectively, is provided with drainage means, and partially by overflowing the bank.

A rotary screen, having a horizontal axis, can be placed at the crusher output to sort the crushed products. The rejects of the rotary screen can be returned to the track or to the crusher input by an internal recycling device comprising a conduit disposed inside the crusher, transversely to the track, means for supplying the said conduit with the screen rejects and, possibly, means for facilitating the flow of the rejects through the conduit. The screen can be integral with the body of the crusher or supported and driven by individual means. Water injection means can be provided in the rotary screen to facilitate discharge of the crushed products and possibly reconstitute with them a pulp of a composition suitable for subsequent processing.

According to a first alternative form of embodiment, the crusher comprises two tracks spaced axially from one another inside a drum with a horizontal axis, two rollers, each suitable for travelling over a track, means for bringing the materials for crushing into the drum, between the two tracks, and means for discharging the crushed materials at the two ends of the drum.

According to another alternative form of embodiment, the crusher comprises several tracks spaced axially from one another inside a drum with a horizontal axis, several rollers, each suitable for travelling over a track, means for introducing the materials for crushing into the drum at one of its ends, means for transferring the materials from one track to the next and means for discharging the crushed materials at the other end of the drum, drainage means for discharging the water being provided between the tracks.

BRIEF DESCRIPTION OF THE DRAWINGS

The description that follows makes reference to the accompanying drawings which show, by way of non-limitative examples, a preferred form of embodiment of the invention and two alternative forms of embodiment. In these drawings

DETAILED DESCRIPTION OF THE INVENTION

Figure 1:
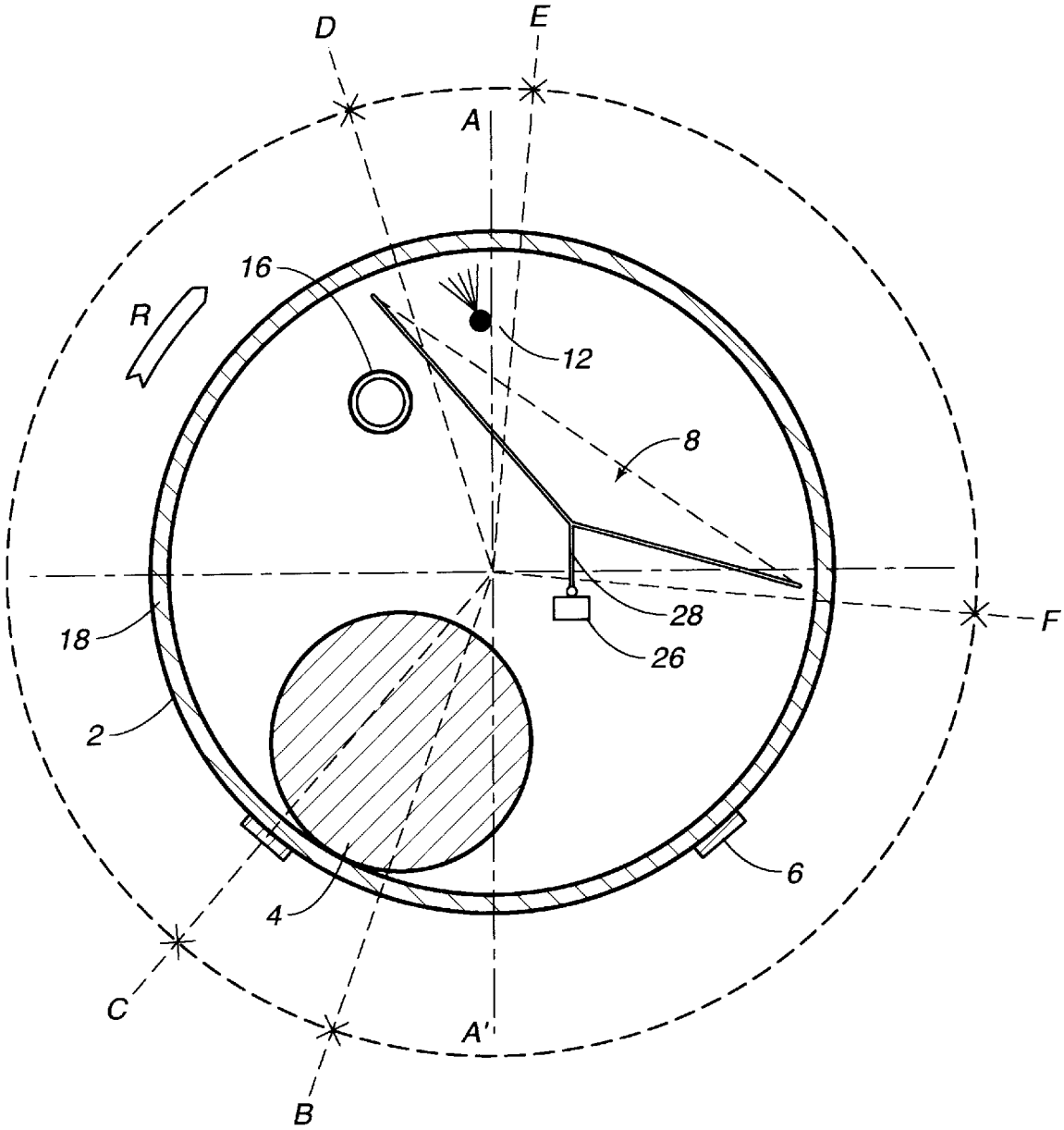
FIG. 1 is a diagrammatic representation, in transverse cross-section, of a crusher designed according to the invention.
Figure 2:
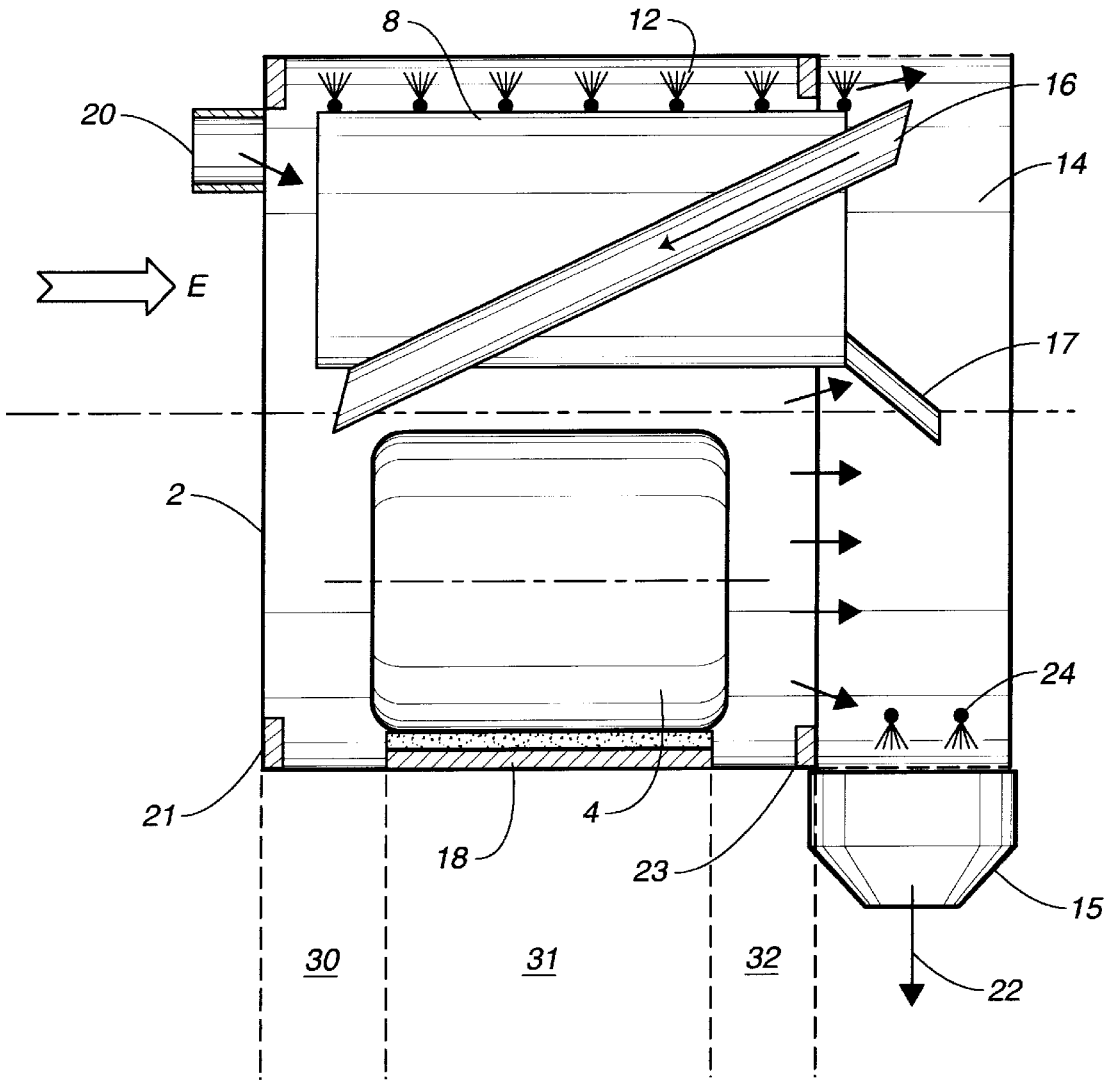
FIG. 2 is a cross-section along line A—A' of FIG. 1, the roller and the internal equipment of the crusher being shown in elevation.

The crusher shown in FIGS. 1 and 2 is a ring type crusher constituted by a drum 2 having a horizontal axis supported by one or more pairs of pads or skids 6 permitting its rotation about its axis. The drum is driven in rotation in the direction of arrow R by conventional means, not shown. It is constituted by a shell the median part of which is internally clad with wear plates and forms a ring bearing the crushing track.

A roller 4 is placed inside the shell so as to travel over track 18 when the drum is driven in rotation. The roller is integral with a shaft parallel to the axis of the drum and the ends of which, which are located outside the drum, are mounted in bearings capable of moving in slide ways or supported by pivoting arms; springs or jacks act on the bearings so as to press the roller against the track with a predetermined, adjustable force. This arrangement is conventional, and the shaft and the bearings have been omitted from the drawings to avoid impairing their legibility. The roller can be idle or driven in rotation by a geared motor.

In the form of embodiment shown in FIGS. 1 and 2, the surface of the track and the peripheral surface of the roller are cylindrical, but they could be frustoconical or cylindroconical, or formed of several portions having different diameters, as described, for example, in U.S. Pat. No. 9,109,788 in the name of the applicant.

The materials for crushing are introduced into the drum via a chute 20 disposed at one end of the drum; at the other end, where the crushed materials are discharged, the shell is prolonged by a cylindrical screen 14 which is surrounded by a collector means 15. Nozzles 24, placed inside the screen 14, enable the crushed materials to be sprayed to improve screening and possibly produce a pulp of suitable composition for subsequent processing.

A chute 16, disposed in the drum, transversely to the track, with an appropriate slope, enables the screen rejects to be returned to the supply area of the crusher. This chute is supplied at one of its ends, for example by a device for scraping the inner surface of the screen: water injection means can be provided to facilitate the flow of the rejects along the chute.

The crusher is equipped with a device for the stepwise feeding of the materials, constituted by water injection nozzles 12 and a screen 8.

Nozzles 12, mounted on a supply pipe, not shown, are disposed in such a way that their jets are directed towards the surface of the track to detach the layer of materials therefrom. The action of the nozzles could possibly be assisted by a scraper, parallel to the axis of the drum and disposed close to the surface of the track, as described in U.S. Pat. No. 9,109,788 in the name of the applicant; preferably, the edge of the scraper will not be in contact with the surface of the track, but at a short distance therefrom, to reduce wear.

Screen 8 is constituted by a flat or curved grid and a collecting recipient. It is mounted on a support 26 so as to be able to pivot about a vertical or inclined axis 28 thanks to a connecting rod and jack system, not shown. It can possibly be mounted to as to be able to pivot about a horizontal axis in order for it to be possible to change its angle of inclination. A chute 17 serves to supply to screen 14 the water and the fine crushed materials collected in the collector means of screen 8. Means can be provided for transmitting oscillations or vibrations to screen 8.

As seen in transverse cross-section, the inside of the crusher can be divided into five clearly defined areas: a crushing area BC, a raising area CD, a scraping area DE, a feed and drainage area EF and a moisture removal area FB.

In longitudinal cross-section, the inside of the crusher can be divided into three areas: a supply area 30, a crushing area 31 and a discharge area 32. The inner cladding of the supply and/or discharge areas can be designed to enable the water to be discharged by drainage.

In operation, the materials for crushing are introduced via chute 20 into the supply area 30 of the drum and there forms in this area a layer of materials the progress of which, parallel to the axis, is controlled by the feed device. A rim 21 of drum 2, the inside diameter of which is substantially equal to that of the layer of materials present on the track forms a barrier permitting the formation of the layer. The speed of rotation of the drum is greater than critical speed, so that the layer of materials is retained on the wall of the drum by centrifugal force, over its entire periphery. A part of the water contained in the materials is possibly discharged in this area by drainage.

To take an elementary volume of the layer of materials present on the track, for example at the upstream end of crushing area BC, this volume is first subjected to crushing by compression between roller 4 and track 18 and then, remaining pressed against the track by centrifugal force, it is raised to the scraping area, where it is detached from the track and broken up by the jets of water from nozzles 12. The grains of material forming this elementary volume then drop onto screen 8, where the water and the grains that are sufficiently fine pass through the screening surface, are collected by the collector means and conveyed to rotary screen 14 via chute 17, while the coarser grains slide along the screen.

The orientation and angle of inclination of the screen are such that the downward movement of the materials over the screen is accompanied by a movement that is parallel to the axis of the drum and the length of which is equal to a fraction of the width of the track. By adjusting the orientation of the screen, it is possible to control the progress of the materials to compel them to undergo several cycles of crushing before being discharged from the crusher. The action of the screen as an element of the stepwise feed device is comparable with that of the deflecting plates in the crusher that is the object of above-mentioned U.S. Pat. No. 9,109,788.

The drained materials drop from the screen onto the track, where they reconstitute a layer from which moisture is removed, through the action of centrifugal force, in area FB, between the point at which they drop and crushing area BC. To permit satisfactory moisture removal, the angular extent of area FB must be at least 30°; the relative positions of roller 4 and screen 8 will be chosen to meet this requirement.

The centrifugal force also produces, in the moisture removal area, a grain size grading of the solid particles, which improves the work of the crusher.

Upon leaving the moisture removal area, the materials enter the crushing area to begin a new cycle. The materials thus pass several times between the roller and the track before reaching the edge of the track adjacent to discharge area 32, the number of crushing cycles being equal to the ratio of the progress per turn, or step, to the width of the track. It can be considered that each fraction of the track having a width equal to one step forms a fictitious track element.

When the materials arrive in the discharge area, they are deflected by screen 8 towards rotary screen 14. The grains of crushed materials the dimensions of which are greater than those of the apertures in screen 14 are returned to the input of the crusher by internal recycling device 16. The fine grains and the water are discharged at 22.

On the output side, the drum is provided with a rim 23, the inside diameter is approximately equal to that of the layer of materials. This rim permits the formation, in discharge area 32, of a bank of materials which prevents an excessive quantity of materials from being entrained by the water when the fluidity of the layer of the materials present on the track is excessive, and which opposes expulsion of the materials through the effect of the pressure of the roller in the crushing area. Rims 21 and 23 can be designed in such a way that their inside diameter can be changed to adapt it to the nature and/or the behaviour of the crushed materials; they can, for example, be formed of exchangeable segments or rings.

Figure 3:
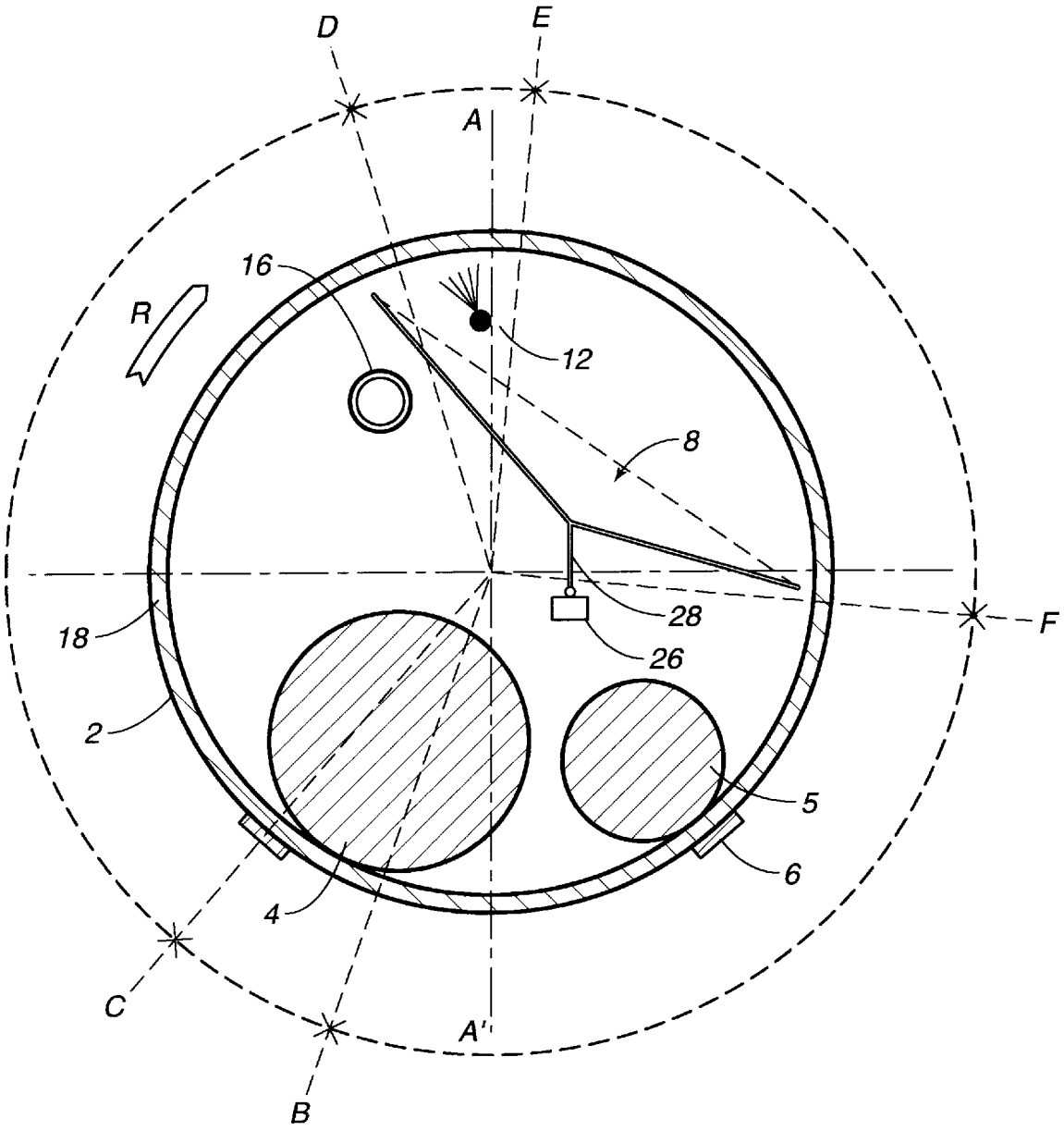
FIG. 3 is a view, analogous to that of FIG. 1, of an alternative form of embodiment.

As shown in FIG. 3, a pre-compression roller 5 can be placed on the track just before the crushing area to supplement removal of moisture from the layer of materials and prevent the water discharged by moisture removal above the layer of materials from reaching the crushing roller. Known means will be used to adjust the pressure exerted by roller 5 on the layer of materials.

Steps can be taken to facilitate the discharge of water in the crushing area: grooving the roller, providing drainage means under the protection plates of the track, etc.

Instead of being integral with drum 2, screen 14 could be supported and driven independently. It could, for example, rotate at a speed below critical speed and be equipped with raising means or scoops enabling the recycling chute 16 to be supplied with the rejects.

Instead of comprising a single track fictitiously divided into track elements, the crusher could comprise several tracks axially spaced apart from one another along the drum, drainage andlor moisture removal means being provided between the tracks.

Figure 4:
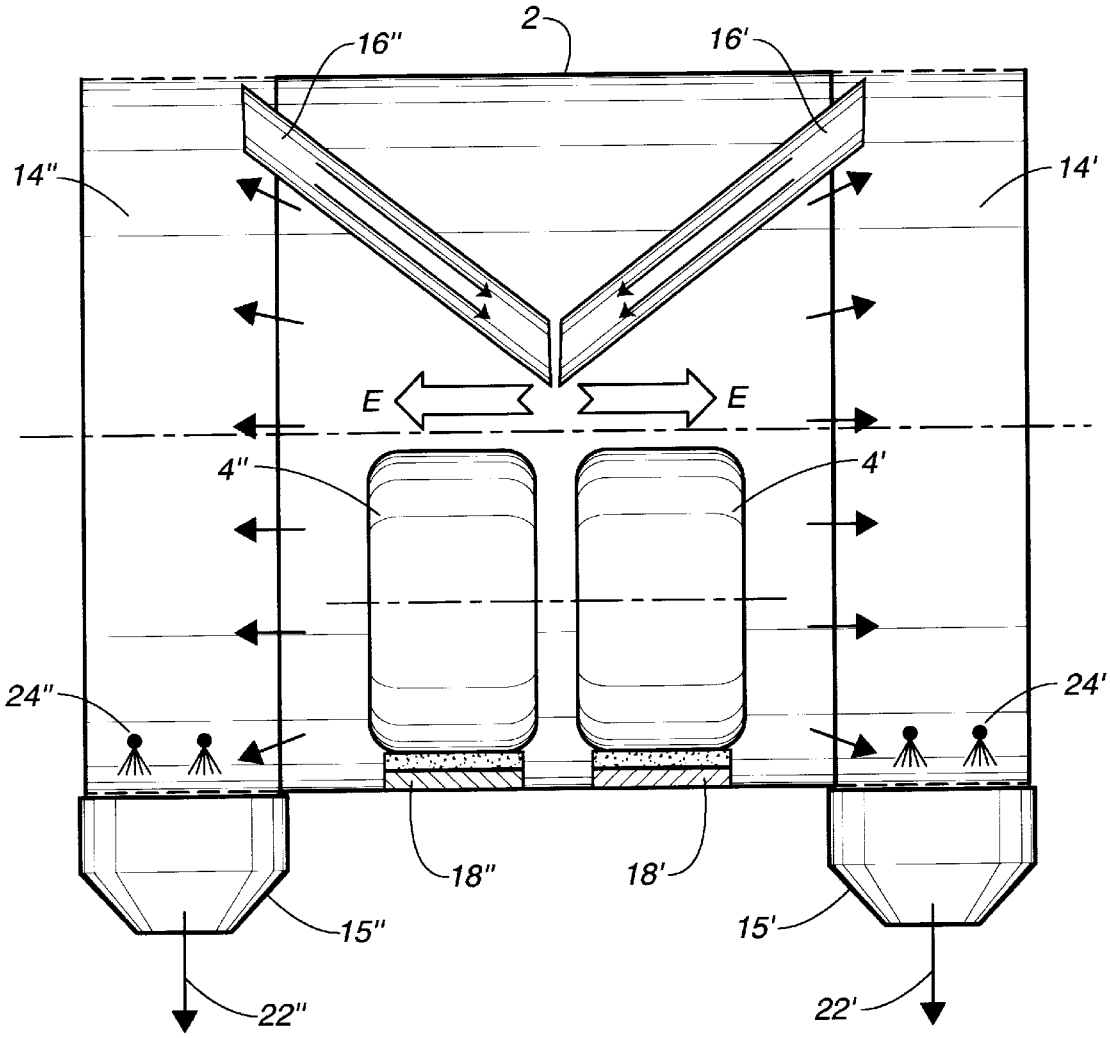
FIG. 4 is a view, analogous to that of FIG. 2, of another alternative form of embodiment.

The crusher shown in FIG. 4 comprises two tracks, 18' and 18", disposed on either side of the median plane of the drum and axially spaced apart from one another, and two rollers 4' and 4" each travelling over a track.

The materials for crushing are brought via a chute, or any other supply means, not shown, into the space between the two tracks, where they form, through the effect of centrifugal force, a layer that is brought onto the two tracks by feed devices.

Each track is equipped with a step wise feed device, for example of the same type as that of the crusher of FIGS. 1 and 2, which ensures the displacement of the materials from the middle towards each end of the drum. These devices are not shown in FIG. 4.

The shell of the drum is prolonged at each of its ends by a cylindrical screen 14', 14" equipped with water injection nozzles 24', 24". Collector means 15', 15" collect the water and the fine grains that have passed through the screens, and two recycling devices, 16', 16" enable the screen rejects to be sent back to the median area of the drum.

Each half of the crusher in FIG. 4 operates like the crusher in FIGS. 1 and 2. For the same production capacity, this construction enables the width of the track to be divided by two, which facilitates discharge of the water in the moisture removal area.

Many changes may be made to the forms of embodiment described through the use of equivalent technical means and it is clearly understood that such changes fall within the scope of the invention.

What is claimed is:

1. A crusher apparatus comprising:

a circular track fictitiously divisible into several elements where successive crushing operations can occur;

a crushing roller travelable over said circular track and elastically compressible against said circular track;

transfer means cooperative with said circular track for transferring material from one element to a next element, said transfer means comprising a projecting means for projecting a liquid onto the material during the transfer of material from said one element to said next element; and drain means cooperative with said circular track for removing moisture from the material prior to passing the material between said crushing roller and said circular track.

2. The apparatus of claim 1, said projecting means comprising a plurality of nozzles capable of projecting liquid under pressure onto the material on said circular track.

3. The apparatus of claim 2, further comprising:

a rotary ring having a horizontal axis, said crushing roller positioned interior of said rotary ring, said circular track being an inner face of said rotary ring, said crushing roller rollable over said inner face;

transport means cooperative with said rotary ring for transporting material for crushing onto said circular track;

feeding means cooperative with said rotary ring for axially displacing material detached from said circular track and returning the displaced material toward said crushing roller for crushing; and discharge means cooperative with said circular track for discharging crushed material, said plurality of nozzles being positioned within an upper portion of said rotary ring, said plurality of nozzles each having a jet directed toward said circular track.

4. The apparatus of claim 3, said transfer means further comprising:

a scraper positioned transversely to said circular track downstream of said plurality of nozzles.

5. The apparatus of claim 3, said feeding means comprising:

a deflecting plate positioned in said rotary ring so as to intercept material detached from said circular track, said deflecting plate being permeable.

6. The apparatus of claim 5, said deflecting plate comprising a flat or curved screen, said discharge means for collecting the liquid and for discharging material passed through said screen.

7. The apparatus of claim 5, said deflecting plate being angularly adjustable about a substantially vertical axis.

8. The apparatus of claim 5, said deflecting plate being angularly adjustable about a substantially horizontal axis.

9. The apparatus of claim 3, said circular track comprising a first element cooperative with said drain means, said first element being between a point where the material detached by said feeding means fall back to said circular track and a point where said crushing roller contacts said circular track, said first element having an angular extent around said circular track of at least 30°.

10. The apparatus of claim 3, further comprising:

a rotary screen aligned coaxially with and on one side of said rotary ring.

11. The apparatus of claim 10, further comprising:

recycling means cooperative with said rotary screen for transporting a portion of material in said rotary screen toward said crushing roller.

12. The apparatus of claim 1, said drain means comprising:

a pre-compression roller positioned against said circular track adjacent said crushing roller so as to remove moisture from the material by pressure.

13. The apparatus of claim 1, further comprising:

a drum having a horizontal axis divided into a supply area and a crushing area and a discharge area, said circular track being positioned in said crushing area, said discharge area having said drain means therein.

14. The apparatus of claim 13, said drum having an annular rim on opposite sides thereof.

15. The apparatus of claim 14, said annular rim having an adjustable inner diameter.

16. The apparatus of claim 1, said circular track comprising a first track and a second track spaced axially from each other, said first track and said second track positioned within a drum having a horizontal axis, said crushing roller comprising a first roller and a second roller each travelable respectively over said first track and said second track, said drum having a first rotary screen positioned on one side of said drum and a second rotary screen positioned on an opposite side of said drum, the apparatus further comprising:

transport means cooperative with said drum for moving the materials into said drum between said first track and said second track.

17. The apparatus of claim 1, said circular track comprising several tracks spaced axially from one another within a drum, said drum having a horizontal axis, said crushing roller comprising several rollers travelable respectively over said several tracks, said transfer means for transferring the material from one track to another track of said several tracks, said drain means being positioned between adjacent tracks of said several tracks, the apparatus further comprising:

transport means cooperative with said drum for moving the material into the drum, said transport means positioned at one end of said drum; and discharge means positioned at an opposite end of said drum for discharging crushed material from said drum.

18. The apparatus of claim 1, said crushing roller having a grooved peripheral surface.

* * * * *